United States Patent [19]

Scoleri

[11] 4,125,923

[45] Nov. 21, 1978

[54] MACHINE FOR THE CRIMPING OF YARNS, IN PARTICULAR FOR PRODUCING FALSE, WAVY HAIRS FOR WIGS

[76] Inventor: Giuseppe Scoleri, Via Per Occhieppo Superiore, 1, Pollone (Vercelli), Italy

[21] Appl. No.: 837,858

[22] Filed: Sep. 29, 1977

[30] Foreign Application Priority Data

Oct. 6, 1976 [IT] Italy ..... 28044 A/76

[51] Int. Cl.[2] ..... D02G 1/00; B29C 17/02

[52] U.S. Cl. ..... 28/278; 264/281

[58] Field of Search ..... 28/278; 264/168, 281, 264/296; 425/391; 57/29, 34 HS

[56] References Cited

U.S. PATENT DOCUMENTS

| | | | |
|---|---|---|---|
| 2,980,959 | 4/1961 | Genoveso | 28/278 X |
| 3,057,015 | 10/1962 | Nichols et al. | 264/281 |
| 3,342,026 | 9/1967 | Nichols et al. | 28/278 X |
| 3,499,276 | 3/1970 | Schmid et al. | 28/278 X |

*Primary Examiner*—Louis Rimrodt

[57] ABSTRACT

A machine for the crimping of yarns, in particular for producing false, wavy hairs for wigs, wherein the yarn, coming from a delivery package, is spirally wound about a cylindrical, supporting element, said yarn being eccentrically led through a mandrel, which is revolvingly driven about said supporting element, coaxially therewith.

4 Claims, 8 Drawing Figures

MACHINE FOR THE CRIMPING OF YARNS, IN PARTICULAR FOR PRODUCING FALSE, WAVY HAIRS FOR WIGS

BACKGROUND OF THE INVENTION

As already well known, multifilament synthetic yarns are often utilized in the production of conventional wigs for women, or for dolls, such yarns being previously treated to impart a given wavy form thereto. Such purpose is attained in practice by having the yarns wound in a tight, continuous spiral, which is then transferred into a heater, whereby to set the crimping.

For such treatment, recourse is presently made to machines wherein the yarn is eccentrically led through a mandrel, which is revolvingly driven about a supporting cyclindrical element, coaxially thereto, whereby to form a continuous spiral winding thereon. While said mandrel is turning, the supporting element should not revolve about its own axis, to prevent a rotation of spiral yarn winding which is being formed.

On the other hand a securing of said supporting element to the machine bed would be impracticable, since the yarn which is being wound is to be passed therethrough.

DESCRIPTION OF THE PRIOR ART

In the heretofore utilized yarn crimping machine, the roation of the supporting element is prevented by counterweights eccentrically associated therewith, whereby to counteract, due to gravity force, the dragging on the part of the revolving mandlel.

However in such already known machines, an undesirable turning of the supporting element on the part of the mandrel often occurs, e.g. due to an insufficient lubrication, or to other causes by which the friction between the supporting element and mandrel is increased. When such ill-effect is incurred, an entangling of threads occurs, whereby the operation is to be stopped, and an intervention is required for restoring the initial conditions.

Moreover, said already known machines are to be usually operated at low RPM of the mandrel, whereby to prevent the above stated ill-effect, which obviously results in low yields.

SUMMARY OF THE INVENTION

The problem which was to be solved by this invention, is to positively prevent a dragging of the supporting element on the part of mandrel, while allowing for high RPM of said mandrel, and thus obtain high outputs.

Briefly, such problem is solved in the yarn crimping machine according to the invention, wherein the thread, coming from a delivery package, is wound about a cylindrical supporting element, such yarn being eccentrically led through a mandrel, which is turning co-axially round the above stated supporting element, said supporting element being retained against rotation by magnetic means, whereby a firm connection thereof with the base plate is attained, while leaving around said supporting element a free annular space, to allow for the passage of yarn, while it is being wound about the supporting element by the revolving mandrel.

The advantage obtained by the invention consists in particular in that said magnetic retainment is unusually efficient and safe, thereby excluding any possibility of dragging of supporting element on the part of the revolving mandrel, even at very high RPM thereof. Moreover the rationality and efficiency of said magnetic restraint allow for a considerable simplification, as well as for an advantageous decrease in the machine sizes, which is then more compact, faster and much more yielding, when compared with the prior art machines.

Various general and specific objects, as well as further advantages of the invention, will become apparent when reference is made to following detailed description of the invention, considered in conjunction with the related drawings.

DETAILED DESCRIPTION OF PREFERRED EMBODIMENT FORM

Figure 1:
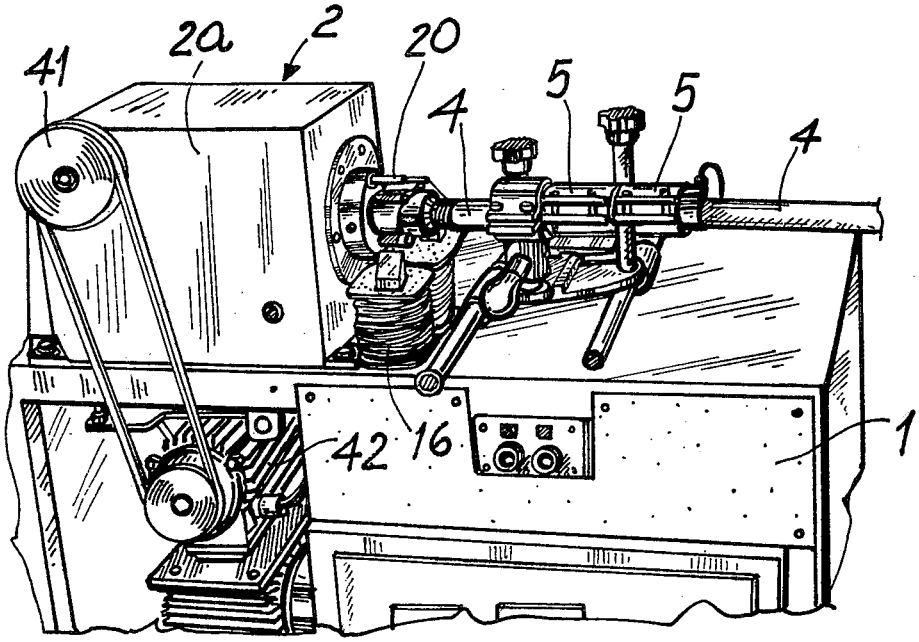
FIG. 1 is a perspective view of the machine according to the invention.
Figure 2:
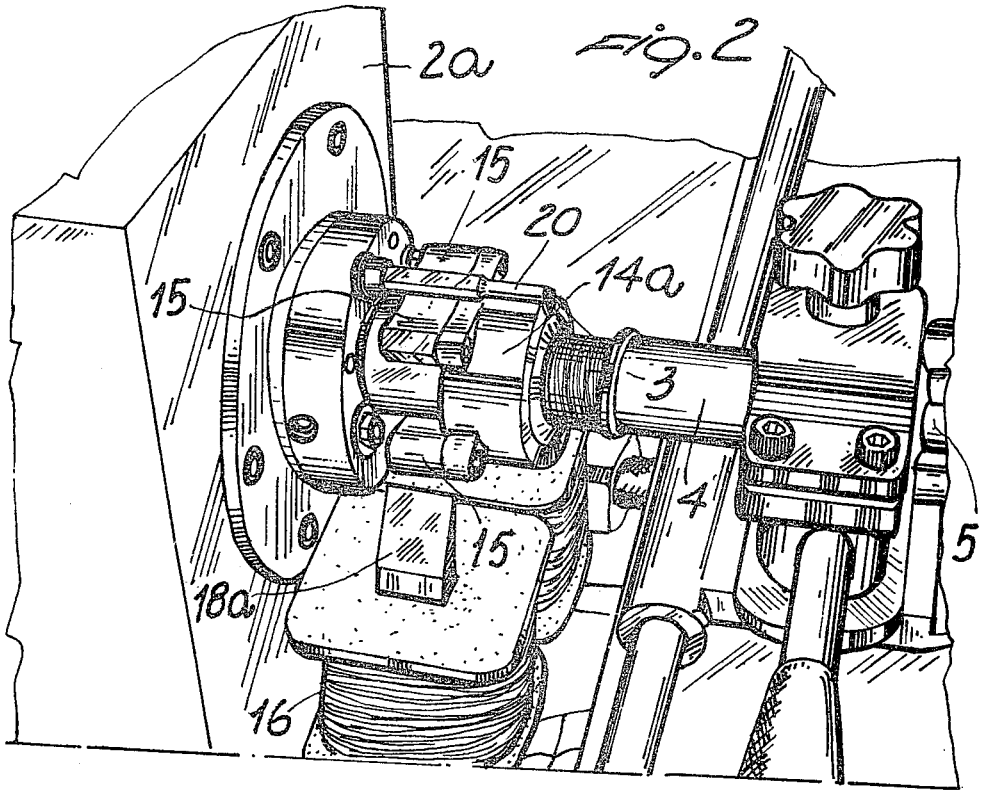
FIGS. 2 and 3 perspectively show a detail of said machine, as seen from two different directions.
Figure 3:
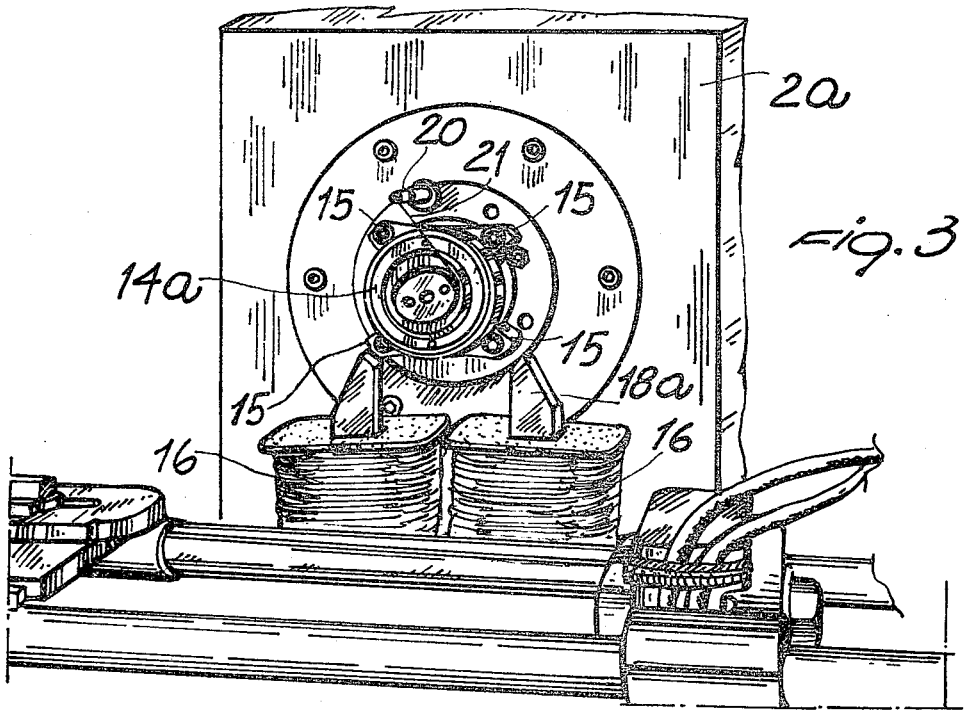
Figure 8:
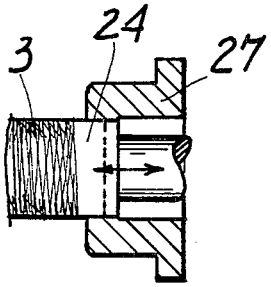
FIG. 8 is a detail of the device by which the yarn spiral winding which is being formed, is gradually discharged.

Referring now in greater detail to the drawings, the machine according to the invention, as shown in the FIG. 1, comprises a bedplate 1, whereon a unit 2, enclosed within a tight box-like shell 2*a*, is supported, included in such unit being a horizontally fitted mandrel (which will be described in more detail later on), by which a yarn spiral winding is continuously formed. Such spiral winding, as denoted by the numeral 3 in the FIGS. 2 and 8, is then discharged into a horizontal stationary tube 4 (see FIGS. 1 and 2), fitted on the bedplate 1 in alignment with the axis of above stated mandrel, and about which heating electric resistances 5 are fitted, whereby to set the crimping of yarn.

Said tube 4 is also designed for guiding the formed spiral winding, and for inserting it into tubular packings (not shown), that are connected with the outlet of said tube.

Figure 4:
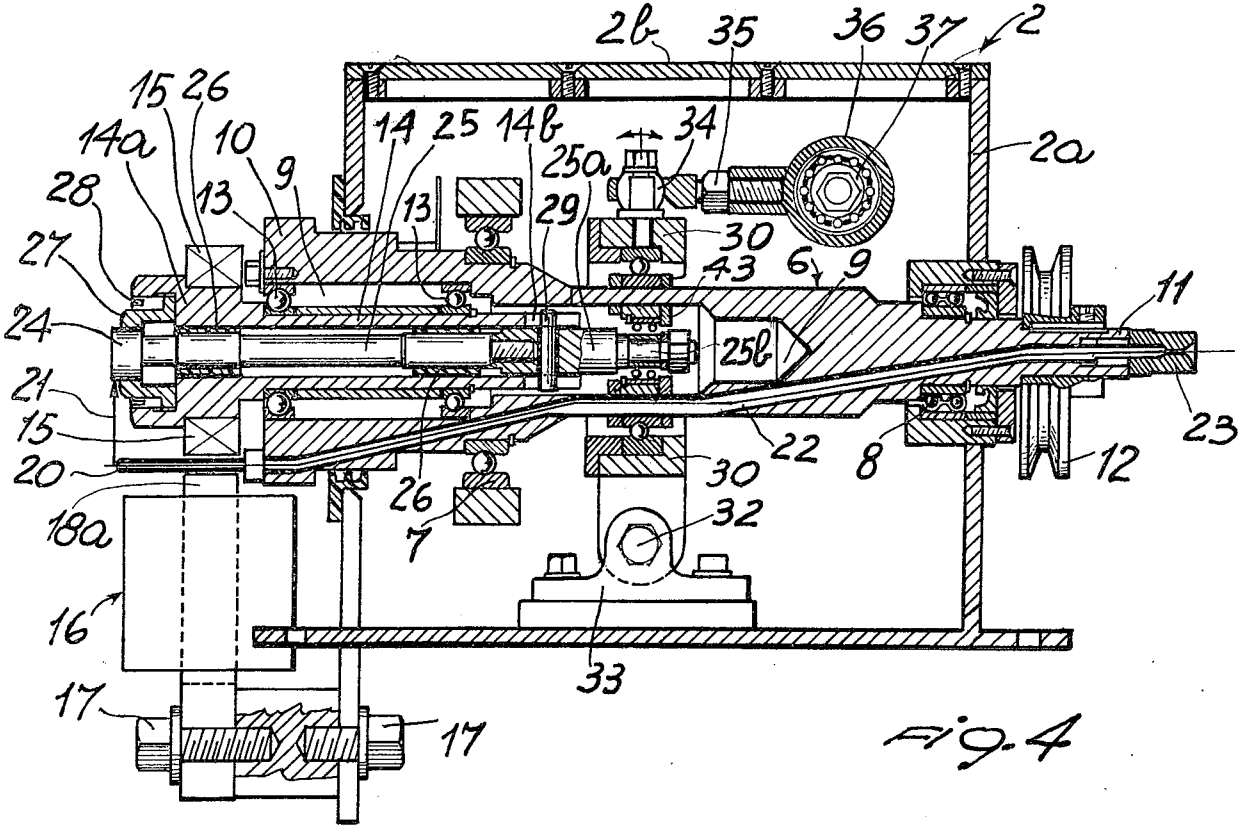
FIG. 4 is a longitudinal section of the main portion of machine.

As shown in the FIG. 4, fitted in the shell 2*a*, which is closed by a cover plate 2*b*, is a horizontal mandrel 6, revolvingly positioned in two bearings 7 and 8, secured to vertical walls of shell 2*a*.

The cross-section of mandrel 6 is stepwise increasing from one to the opposite end, said mandrel being formed with an inner cavity 9, that extends through a given length toward the larger end 10, where said cavity opens to the outside.

The ends 10 and 11 of mandrel 6 protrude for a short length out of box-like shell 2*a*. Fitted on the smaller end 11 is a pulley 12, that forms a part of a belt transmission driven by a related motor (not shown).

Fitted in the cavity 9 of mandrel 6 is sleeve 14, revolvingly bearing 13, and which outer end protrudes, also for a short length, out of end 10 of said mandrel 6. The outer portion 14*a* of sleeve 14 has an elongated cross-section, from which four lateral shoes 15 radially extend, said shoes being spaced at angles of 90° (see FIGS. 2, 3, 4, 5).

The sleeve 14 and their radial shoes 15 are made of a ferromagnetic material, and said shoes 15, along with a part of sleeve 14, form a part of a magnetic circuit, deriving from an electromagnet 16, which is fastened by the screws 17, to the shell *2a*, i.e. to machine bedplate 1. The core 18 of electromagnet 16 is U-shaped with its branches vertically extending below the jutting-out length 14*a* of mandrel 14 and in coincidence with the shoes 15, the ends 18*a* of core 18 being located in such a manner as to act upon two adjacent shoes 15, as shown in the FIG. 5.

Said ends 18*a* are moreover positioned in such a manner as to define a large air gap 19 (see FIG. 5) between them and the shoes 15.

Figure 5:
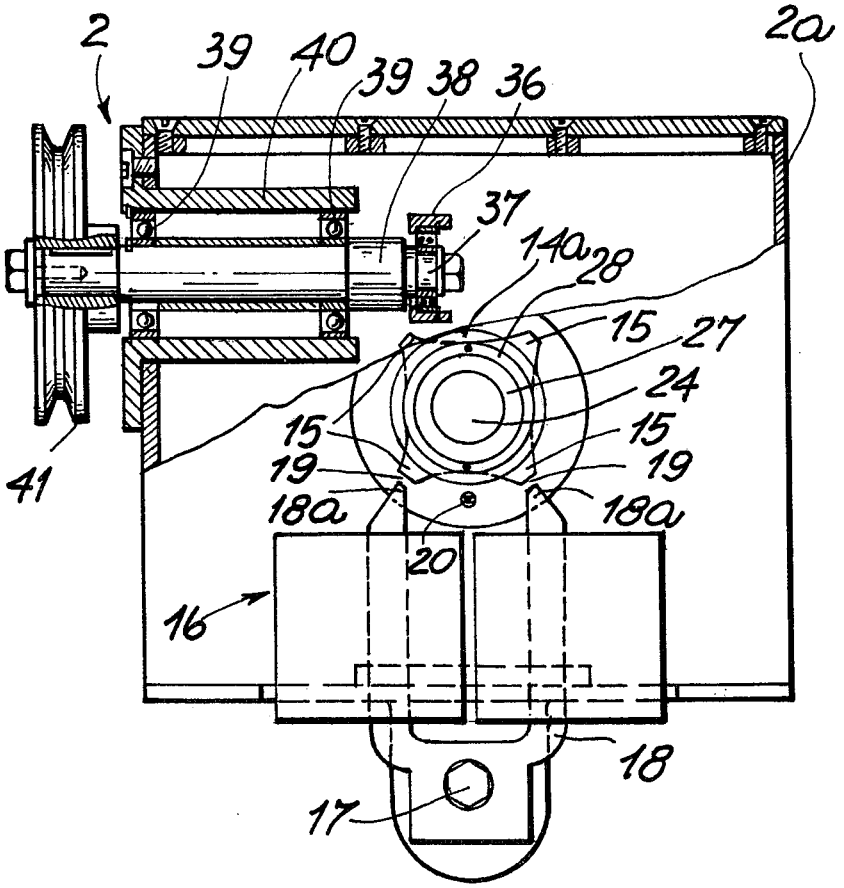
FIG. 5 is a part-sectional front view of the main portion of machine, as shown in the FIG. 4.

When the electromagnet 15 is de-energized, the sleeve 14 can freely turn about its own axis; however, when said electromagnet is energized a magnetic flux is established across the core 18, the shoes 15 and a part of sleeve 14, whereby the rotation of sleeve is prevented, and it is retained in a fixed position, with two of the shoes 15 facing the ends 18*a* of core 18, as shown in the FIG. 5.

A nozzle 20, eccentrically fitted on the end 10 of mandrel 6 with its axis parallel to that of said mandrel, is allowed to pass across the air-gap 19 between the shoes 15 and the core 18.

Out of nozzle 20 comes the yarn 21 (see FIGS. 3 and 4), which is designed to form the continuous spiral winding that is then discharged into the tube 4, said yarn running within a guide tube 22, embodied in the mandrel 6 and connected with the nozzle 20. In more detail, the guide tube 22 is inclined with respect to the axis of mandrel 6, with one of its ends eccentrically located and in alignment with the nozzle 20, while the opposite end is located co-axially with the mandrel, in coincidence with the end 11 whereon the pulley 12 is fitted.

The yarn is introduced into the guide tube 22 through a bush 23, which is fastened co-axially to end 11 of mandrel 16, said yarn being delivered from a package (not shown), located near said bush 23.

The yarn 21 is wound, in the form of a spiral winding 3, on a supporting cylindrical element 24 (FIGS. 4 and 8), which is secured to a stem 25, coaxially fitted within the sleeve 24 and positioned in bronze bearings 26 (see FIG. 4). To further the discharge of yarn spiral winding 3, a short axial reciprocating motion is imparted to supporting element 24 and to related stem 25, said element 24 being inserted into a tightly tight fitting 27, which is secured to head 14*a* of sleeve 14 by a threaded ring 28.

An action substantially similar to that of a punch is exerted by the supporting element 24, along with its stem 25, which is reciprocated within the bronze bushings 26, whilst the sleeve 14 is retained by the above described magnetic system. To prevent any possible rotary motion of stem 25 relative to sleeve 14, the inner end of said sleeve is formed with two diametrally opposite and axially extending notches. Slidingly engaged in said notches are both ends of a crosswise directed rod 29 (see FIG. 4), which is fitted in an also crosswise directed bore formed in an extension 25*a* of stem 25. Thus, an axial reciprocating motion can be imparted to supporting element 24, without any angular motion thereof about its own axis, in respect of sleeve 14.

According to this invention, for imparting said axial reciprocating motion to supporting element 24, a particular device is provided that allows it to act upon the inner extension 25*a* of stem 25, while the mandrel 6 is turning.

Figure 7:
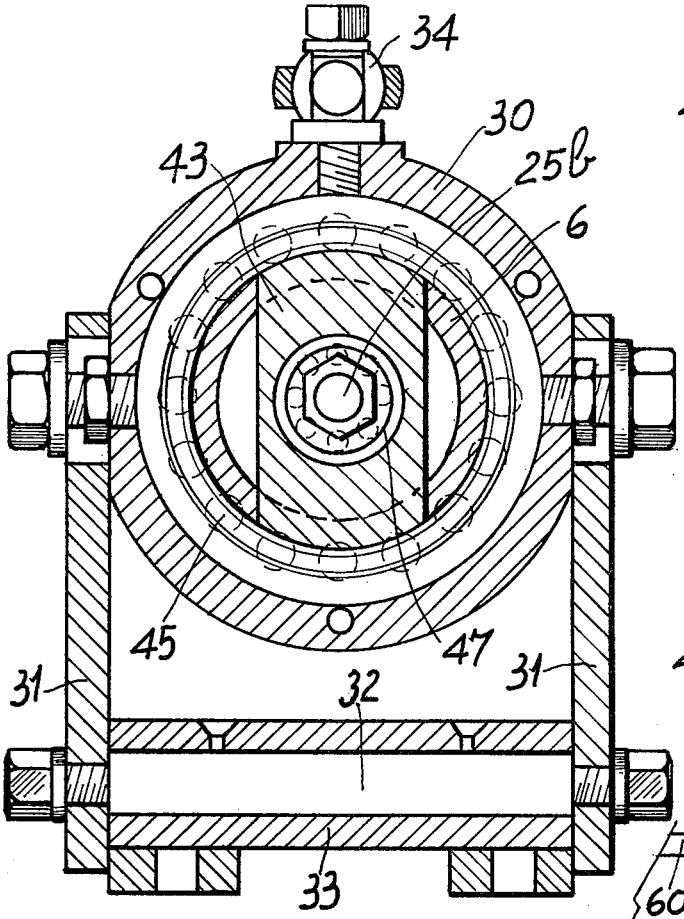
FIG. 7 is a section taken on the line VII—VII of FIG. 6.
Figure 6:
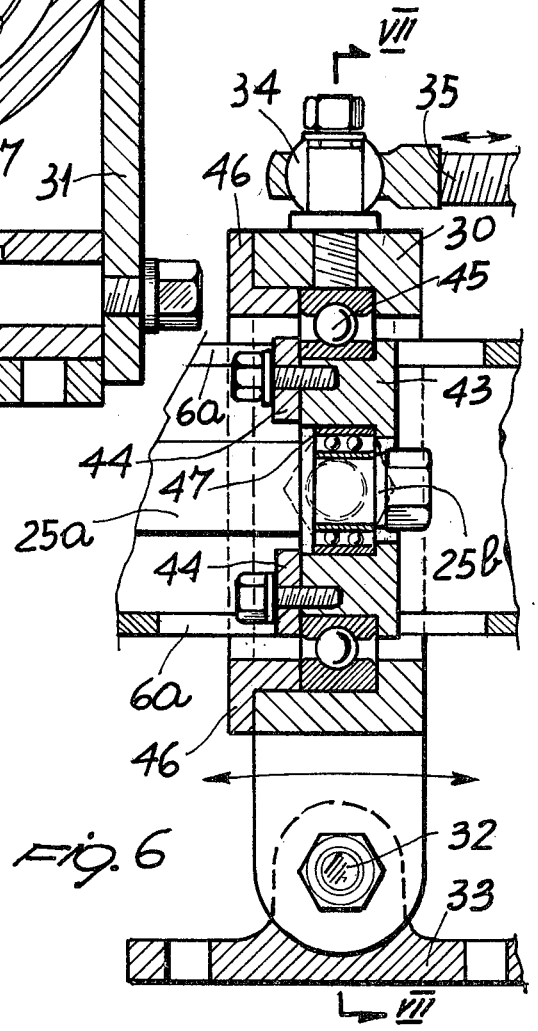
FIG. 6 is a cross section of a detail of the machine, forming part of the feeding device of yarn which is being spirally wound.

Said device comprises an annular body 30, fitted around the end section 25*b* of extension 25*a* of the mandrel 6 (see FIGS. 4, 6 and 7). Fixed with said annular body 30 are two arms 31, which can perform an oscillating motion about a pin 32, that is horizontally fitted below the mandrel 6, crosswise to axis the thereof, said pin 32 being secured to ded plate 1 of machine by a suitable support 33.

Thus, the annular body 33 is allowed to perform a restricted swinging motion about the axis of pin 32. To such a purpose, fitted on top of annular body 30 is a pin 34, having a spherically shaped end, which is pivotally connected with one end of a connecting rod 35, having a bearing 36 fitted on its opposite end, an eccentric 37 being revolvingly fitted in said bearing 36 (see FIGS. 4 and 5). Said eccentric 37 is keyed to a horizontal spindle 38, revolvingly positioned in bearings 39, that are supported by a sleeve 40 secured to box-like shell 2*a* (see FIG. 5). Keyed on one end of spindle 38, that projects out of said box-like shell, is a pulley 41, which is driven by an electric motor 42 by a belt transmission (see FIGS. 1 and 5). Obviously, the drive to mandrel 6 and to spindle 38 may be imparted by a single electric motor, instead of two separate motors.

Thus, when the spindle 38 is driven, an oscillating motion is performed by the annular body 30 round the axis of pin 32.

A crosswise directed plate 6*a*, slidingly fitted in a suitable slot 43 with which the mandrel 6 is formed (see FIGS. 6 and 7) is provided for transmitting the swinging motion of annular body 30 to stem 25. Said plate 43 is secured by fasteners 44 (see FIG. 6) to inner the side of a bearing 45, whose outer side is firmly connected with the annular body 30 by a fastener 46. Thus, the plate 43 is allowed to revolve within the annular body 30, and simultaneously it can be axially shifted all along the slot 6*a* of mandrel 6 (a turning of plate 43 with respect to mandrel 6 is however prevented by the slot 6*a*).

Fitted on the middle of plate 43 is a bearing 47, in which the end 25*b* of extension 25*a* of stem 25 is revolvingly fitted. The arrangement is such that the plate 43 is allowed to turn about the axis of stem 25, said stem however being axially restrained in respect to said plate 43.

Thus, the swinging motion of annular body 30 results with a reciprocating motion being imparted to stem 25, while simultaneously allowing a rotation of mandrel 6 (whilst, when the electromagnet 16 is energized, no rotary motion can be performed by the stem 25 about its own axis).

The possibility to fit supporting elements 24 having different diameters is provided. To such a purpose, the stem 25 is joined by a screw connection with its extension 25*a*, while provisions are made for replacing the bush 27 by another bush having an inner diameter equal to the diameter of the element 24 which is to be utilized in each case.

The operation of the machine according to the invention is as follows:

After having threaded the yarn end across the guide tube 22 and the nozzle 20, a few yarn turns are manually wound about the supporting element 24, whereupon the machine can be started, thereby causing the rotation of mandrel 6 and the simultaneous axial reciprocating motion of supporting element 24.

At the same time, the electromagnet 16 is to be energized, whereby to magnetically lock the sleeve 14.

By the rotation of mandrel 6, the nozzle 20, which is connected therewith, is pushed into the air gap 19, whereby the yarn is wound about the supporting element 24, thus forming the spiral winding 3 (see FIG. 8). No influence is exerted on the magnetic locking of sleeve 14 by the introduction of nozzle 20 into the air gap 19. On the contrary it has been ascertained in the practice that, when the nozzle 20 is made of a ferromagnetic material, the magnetic locking action of sleeve 14 is even increased.

While the spiral winding 3 is wound by the nozzle 20, said winding is successively discharged due to axial reciprocating motion of supporting element 24, also with the aid of bush 27.

Indeed, as previously described, the swinging motion of annular element 30, caused by the eccentric 37, is transmitted through the bearings 45 and 47 and the plate 43, to stem 25 by which the supporting element 24 is carried. The lubrication may be of the oil-bath type, by feeding the lubricant into the tightly closed shell 2*a*.

As previously stated, for changing the diameter of spiral winding 3 it is sufficient to have the supporting element 24, along with the related bush 27, replaced by another supporting element 24 (coupled with the related bush) having the required diameter. Such operation is made possible by the fact that the stem 25 of element 24 is screwed to its extension 25*a*.

The feeding of yarn, which is unwound from its package when wound about the supporting element 24, occurs in a particularly regular and uniform manner through the guide tube 22, thanks above all to the fact that the tube inlet is located co-axially with the mandrel 6.

The thus obtained spiral winding is successively discharged into the tube 4, where the crimping is set by the heat of electric resistances 5. At the outlet of tube 4, the spiral winding 3 may be directly utilized, or even packed for storage and transport.

As it can be readily appreciated, the particular magnetic locking system according to the invention, allows for a trouble-free operation of the machine at very high RPM of the mandrel, and thus with unusually high yields.

Moreover, with said magnetic locking system, the machine is simplified and is made more reliable, when compared with the prior art machines.

In addition, the device according to the invention, by which an axial reciprocating motion is imparted to the supporting element 24, can be considered as thoroughly engineered and efficient, since it allows to solve in a very ingenuous manner the problem of transmitting an axial motion to a body located inside of a revolving mandrel.

While the invention has been described in detail with respect to a now preferred embodiment thereof, it will be understood, by those skilled in the art, that various changes and modifications may be made therein, without departing from the spirit and scope of said invention.

What I claim is:

1. A machine for the crimping of yarns, in particular for producing false, wavy hair for wigs, comprising a bed plate, a mandrel rotatably mounted on the bed plate, a cylindrical supporting element, said mandrel being disposed co-axially about said supporting element, said yarn being fed from a feeding package and led eccentrically through said mandrel and spirally wound about said supporting element, magnetic means connected on said bed plate operative to prevent rotation of said supporting element to retain same in a fixed position, and a control mechanism for axially reciprocating said supporting element for discharging said yarn in cooperation with a bush disposed therebout while said yarn is continuously wound about said supporting element.

2. A machine according to claim 1, wherein said supporting element is non-rotatably fitted within a sleeve, said sleeve being fitted co-axially and rotatably within said mandrel, and there is at least two ferromagnetic shoes provided on an end of said sleeve, said magnetic means comprising an electromagnet having a U-shaped core for cooperating with said shoes.

3. A machine according to claim 1, wherein said control mechanism comprises a plate, a stem connected with said supporting element rotatably connected with said plate, a crosswise directed slot formed in said mandrel, said plate being slidably fitted within said slot, said slot permitting reciprocatory motion of said plate in the direction of the axis of said mandrel, an annular body crosswise fitted about said mandrel accommodating the end of said plate in a manner permitting the rotation of said plate together with said mandrel, said annular body being connected to said machine bed plate such that it can oscillate about an axis perpendicular to the axis of said mandrel, and an eccentric drive for oscillating said annular body about its axis for consequent axial reciprocating motion of said stem of said supporting element.

4. A machine according to claim 1, wherein said yarn is fed from said feeding package through a guide tube supported on said mandrel in a position substantially inclined to the axis of the mandrel, said tube having an inlet portion coaxial to the axis of the mandrel and an outlet portion parallel to but spaced from said axis by a predetermined length.

* * * * *